US007090633B2

(12) United States Patent
Hall et al.

(10) Patent No.: US 7,090,633 B2
(45) Date of Patent: Aug. 15, 2006

(54) CENTRIFUGE ROTOR LID HOLDER DEVICE

(75) Inventors: Richard A. Hall, Southbury, CT (US); R. Gary Potter, Southbury, CT (US); Vincent Saviano, Sandy Hook, CT (US)

(73) Assignee: Thermo Electron Laboratory Equipment LLC, Asheville, NC (US)

( * ) Notice: Subject to any disclaimer, the term of this patent is extended or adjusted under 35 U.S.C. 154(b) by 139 days.

(21) Appl. No.: 10/434,116

(22) Filed: May 9, 2003

(65) Prior Publication Data

US 2003/0220181 A1 Nov. 27, 2003

Related U.S. Application Data

(60) Provisional application No. 60/381,788, filed on May 21, 2002.

(51) Int. Cl.
*B04B 7/02* (2006.01)
*B04B 15/00* (2006.01)

(52) U.S. Cl. ..... 494/12; 494/60

(58) Field of Classification Search ..... 494/12, 494/16, 20, 60, 37, 43, 82, 85
See application file for complete search history.

(56) References Cited

U.S. PATENT DOCUMENTS 1,989,213 A * 1/1935 Schenck
2,321,144 A * 6/1943 Jones
2,783,938 A * 3/1957 Grela et al.
3,111,863 A * 11/1963 Filz
3,240,425 A * 3/1966 Ray et al.
3,244,363 A * 4/1966 Hein
3,567,113 A * 3/1971 Stansell et al.
3,720,368 A * 3/1973 Allen
3,750,941 A * 8/1973 Drucker
4,010,893 A * 3/1977 Smith et al.
D303,569 S * 9/1989 Eberle
D303,570 S * 9/1989 Eberle
5,067,938 A * 11/1991 Uchida et al.
5,242,370 A * 9/1993 Silver et al.
5,312,319 A * 5/1994 Salter
5,326,398 A * 7/1994 Kelley et al.
5,409,443 A * 4/1995 Zabriskie et al.
5,480,484 A * 1/1996 Kelley et al.
D367,867 S * 3/1996 Suzuki et al.
5,505,683 A * 4/1996 Geringer et al.
5,665,047 A * 9/1997 Brimhall
5,855,545 A * 1/1999 Kishi et al.
5,924,972 A * 7/1999 Turvaville et al.
6,056,684 A * 5/2000 Linder et al.
6,241,650 B1 * 6/2001 Letourneur
2003/0220181 A1 * 11/2003 Hall et al.

FOREIGN PATENT DOCUMENTS

DE 3727168 A1 * 2/1989
JP 2002-273271 * 9/2002

* cited by examiner

*Primary Examiner*—Charles E. Cooley
(74) *Attorney, Agent, or Firm*—Baker & Hostetler LLP

(57) ABSTRACT

A lid holder for use in centrifuge systems, particularly suited for rotor lids. A lid holder including a lid support and a lid receiving end for holding a centrifuge rotor lid on a centrifuge that may not have a hinged door. A method for securing a centrifuge rotor lid to a centrifuge that may not have a hinged door.

5 Claims, 6 Drawing Sheets

CENTRIFUGE ROTOR LID HOLDER DEVICE

PRIORITY

This application claims priority to the provisional U.S. patent application, entitled "Centrifuge Rotor Lid Holder Device", filed May 21, 2002, having a Ser. No. 60/381,788, the disclosure of which is hereby incorporated by reference.

FIELD OF THE INVENTION

The present invention relates generally to lid holders. More particularly, the present invention relates to a centrifuge rotor lid holder.

BACKGROUND OF THE INVENTION

A centrifuge instrument is a device by which liquid samples may be subjected to centrifugal forces. The sample is placed in a container such as a test tube, which is then carried within a device known as a centrifuge rotor. The rotor is mounted to a rotatable drive shaft that is connected to a source of motive energy. The rotor may have a lid that is secured in place on the rotor by a locking screw, which passes through the lid and is secured to the rotor or the drive shaft. The lid improves the aerodynamics, of the rotor, decreasing the air resistance and noise generated when the rotor is spun. In some instances, the lid forms a seal with the rotor body preventing leakage from the rotor should sample leak from its container during operation. A sealed rotor also facilitates operation in a centrifuge with an evacuated chamber.

Centrifuges currently employed in laboratories are generally operated by manual controls using various settings and procedures. A rotor control may be used to select a specific size or type of rotor to be used in the centrifuge. Typically, there is a wide selection of rotors compatible for use with a given centrifuge. A speed control is used to select the desired speed for the customer's protocol. The speed selected and the geometric configuration of the rotor used, specifically the radius, cooperate to expose the sample to centrifugal force. The centrifugal force on the sample is compared with the force that the earth's gravity would have on the sample, called the Relative Centrifugal Force (RCF). Alternatively, a RCF control can be used to directly set the desired RCF. A timer and temperature control are also frequently used to set the time of the protocol and control the sample temperature during the run. There are conventional power switches to manually turn the centrifuges on or off as needed.

Centrifuges commonly have a door that must be opened to access the rotor and its contents or samples and must be closed to operate the centrifuge. The rotor is secured to a drive shaft in the centrifuge and holds the liquid samples to be subjected to the centrifugal force created as the rotor is rotated by the drive shaft.

It is desirable to have a rotor lid holder to hold the rotor lid when it is removed from the rotor to load and unload samples. Typical centrifuges have minimal flat space on which to rest the lid during sample loading and unloading. Even where there is sufficient space on the centrifuge or where available bench space is located near by, the lid is not held in place and is susceptible to becoming dislodged and potentially damaged. As shown in FIG. 6, current rotor lid holder devices 50 are generally located on the underside of the centrifuge door. Therefore, rotor lid holder devices presently require the centrifuge door to be opened in order to utilize the holder apparatus. The door is usually hinged with the lid holder located underneath and integral to the door. Additionally, current lid holders may only be compatible with a single size of rotor lid. The rotor control panel and displays are set apart from the lid holder in the current design.

This configuration of a rotor lid holder device cannot be used on horizontally retracting centrifuge doors.

Present rotor lid holder devices are posts that mate with the rotor lid so that the lid may be attached to the post on the underside of the centrifuge door. Therefore, only rotor lids with a certain sized and designed screw hole will properly mate with the post.

Accordingly, a centrifuge rotor lid holder device and method for securing a rotor lid to a centrifuge that may have a retracting centrifuge door are desired.

Additionally, a centrifuge rotor lid holder device and method for securing a variety of rotor lid configurations and sizes to a centrifuge are also desired.

SUMMARY OF THE INVENTION

It is therefore a feature of the present invention to provide a centrifuge rotor lid holder with a rotor lid receiving end connected to a centrifuge where the receiving end is at the top of a control console or on the top case of a centrifuge, so that it can be used to hold a centrifuge rotor lid without having to open the door of the centrifuge. Having a rotor lid holder allows the user to set the rotor lid aside, freeing their hands for loading and unloading samples. It also provides a definitive location for the rotor lid at the centrifuge saving the customer time and effort to find a suitable location to place the lid.

It is another feature of the present invention to provide a centrifuge rotor lid holder that can be placed on a centrifuge with a retracting door.

It is yet another feature of the present invention to provide a centrifuge rotor lid holder that is compatible with a greater plurality of rotor locking screw sizes and lid locking screw sizes.

Also provided is a method for securing a centrifuge rotor lid with a locking screw to a centrifuge, the method comprising the step of inserting the rotor locking screw or lid locking screw into a lid receiving end.

A centrifuge rotor lid holder with means for securing a centrifuge rotor lid to a centrifuge is also provided.

It is understood that the invention includes one, some or all of the features and advantages of the invention. It is further understood not all embodiments are required to encompass all features and advantages of the invention.

The above and other features and advantages are achieved through the use of a novel centrifuge rotor lid holder device as herein disclosed. In accordance with one embodiment of the present invention, a device for securing a centrifuge rotor lid to a centrifuge is provided. The device is a rotor lid holder that has a rotor lid receiving end.

The lid receiving end is connected to a centrifuge, preferably to the top of the control console of the centrifuge. When the lid receiving end is located at the top of the control console, it is easily visible to a user. It is important to avoid operating the centrifuge without the rotor lid attached to the rotor. If the rotor lid is inadvertently left unattached to the rotor, a mishap may occur during centrifuge operation. When the rotor lid is secured by the lid holder in this location, the user may be visually alerted that the rotor lid has not been attached to the rotor prior to operation of the centrifuge.

The lid receiving end is attached to the centrifuge. The lid receiving end can receive the locking screw of the rotor lid. The lid receiving end is capable of receiving rotor locking screws or lid locking screws of various sizes. The lid receiving end may be molded in a piece of the control console or top case of the centrifuge. It may also contain a damper that prevents damage, dampens noise, or provides a grip for the rotor locking screw or lid locking screw.

In one embodiment, the receiving end is capable of receiving and securing the rotor lid by inserting the rotor locking screw or lid locking screw into the receiving end. In another embodiment, the lid receiving end is capable of receiving and securing the rotor lid by screwing the rotor locking screw into the receiving end.

The present invention is also achieved through a method for securing a centrifuge rotor lid with a locking screw to a centrifuge. A preferred method involves inserting the rotor locking screw or lid locking screw into a lid receiving end that is attached to the centrifuge.

The method may also comprise placing the rotor lid on a receiving end that is connected to a centrifuge. The rotor locking screw or lid locking screw is then screwed into the receiving end.

Alternatively, the method may secure the rotor lid by placing a circular edge of the rotor lid on a receiving end that is connected to a centrifuge. The circular edge of the rotor lid's locking screw may also be placed on a receiving end that is connected to a centrifuge.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

The present invention provides a novel centrifuge rotor lid holder for securing a centrifuge rotor lid to a centrifuge. The rotor lid holder has a rotor lid receiving end.

Figure 1:
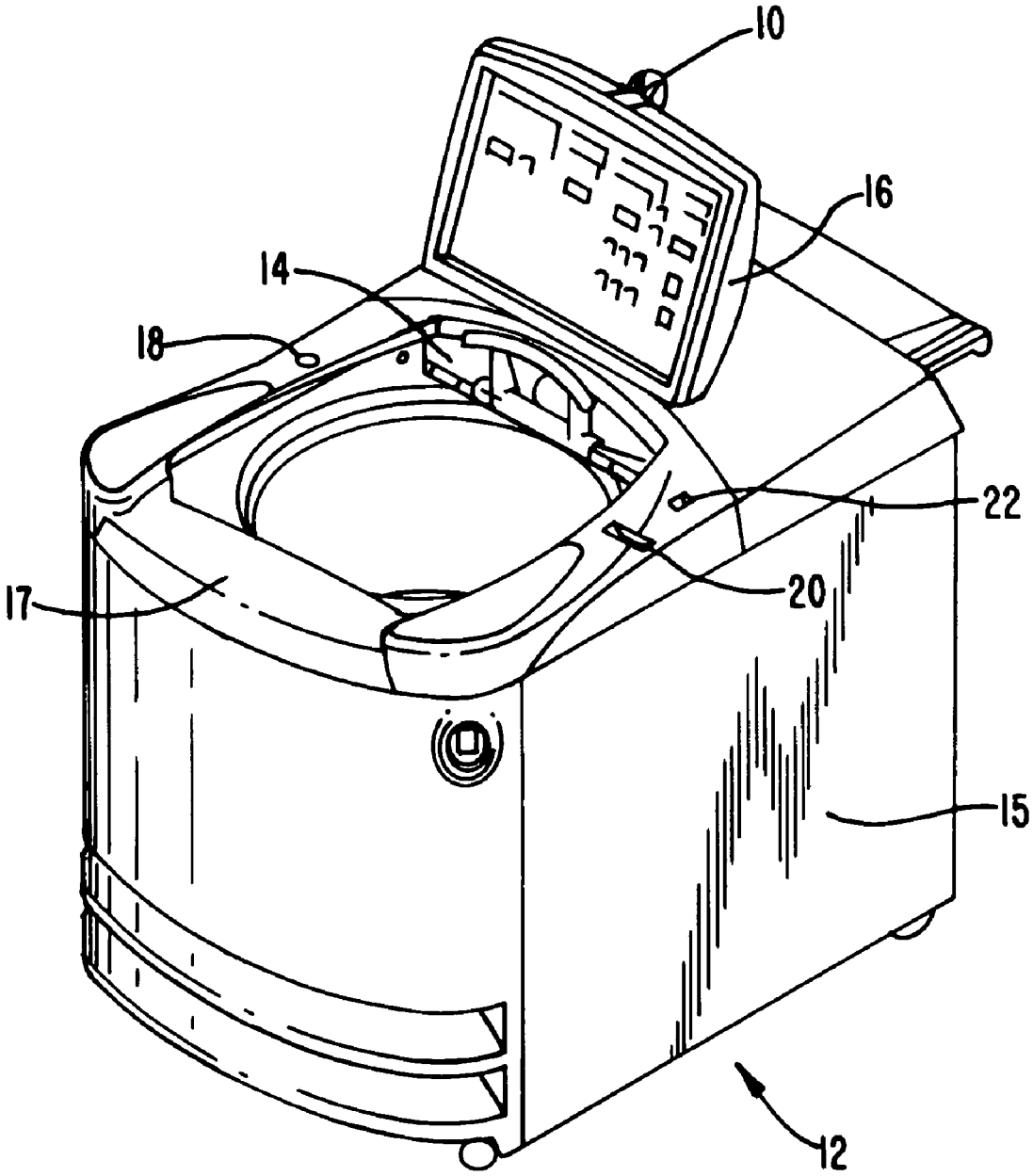
FIG. 1 is a perspective view of a centrifuge with a lid holder device according to a preferred embodiment of the present invention.
Figure 2:
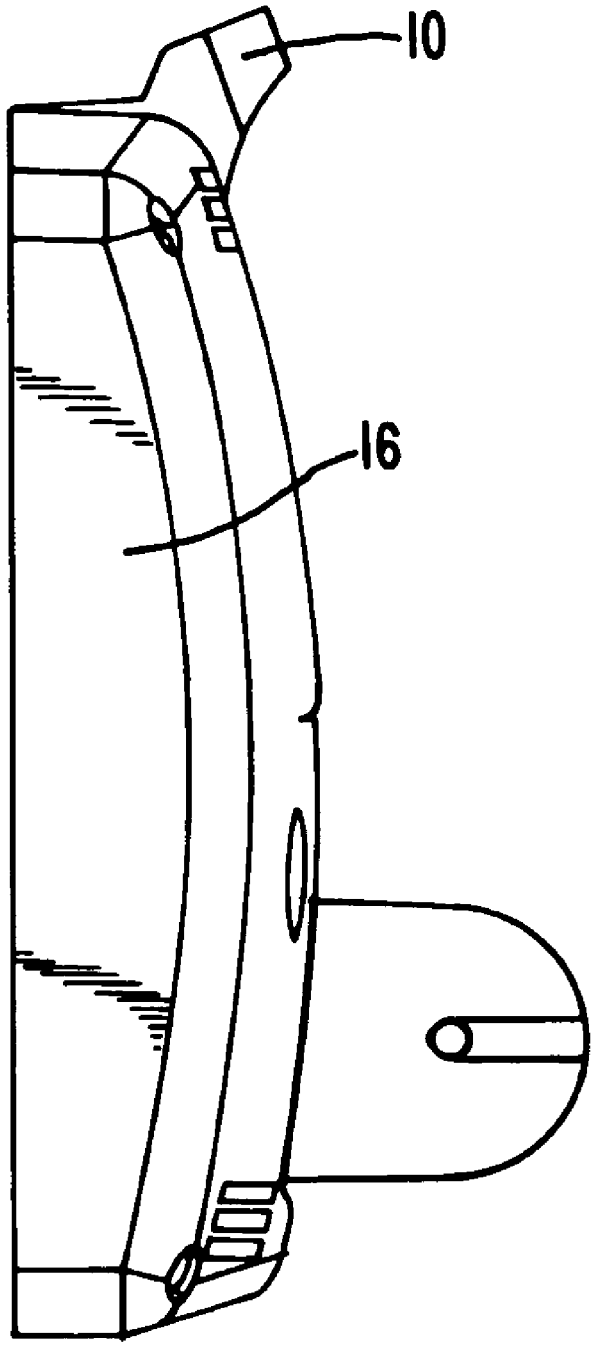
FIG. 2 is a plan view of a lid holder device on a control panel of a centrifuge according to a preferred embodiment of the present invention.

Referring to FIGS. 1 and 2, a preferred embodiment of the invention provides a rotor lid receiving end 10 attached to a centrifuge 12 with a retracting door 14 to provide a convenient and safe manner to store a rotor lid 40. The location of the lid receiving end 10 on top of the control console 16 may also alert the user that the lid 40 has not been attached to the rotor prior to operation of the centrifuge 12. In an alternate embodiment, the rotor lid receiving end 10 may be located on a centrifuge with a non-retracting door, such as a hinged door (not shown).

In another embodiment of the present invention, the rotor lid receiving end 10 can be located on the centrifuge housing 15. One possible location for the rotor lid receiving end 10 on the housing 15 is the top case 17 of the centrifuge. In this alternate location, the user would still be alerted that the lid 40 has not been attached to the rotor prior to operation of the centrifuge system 12.

Figure 3:
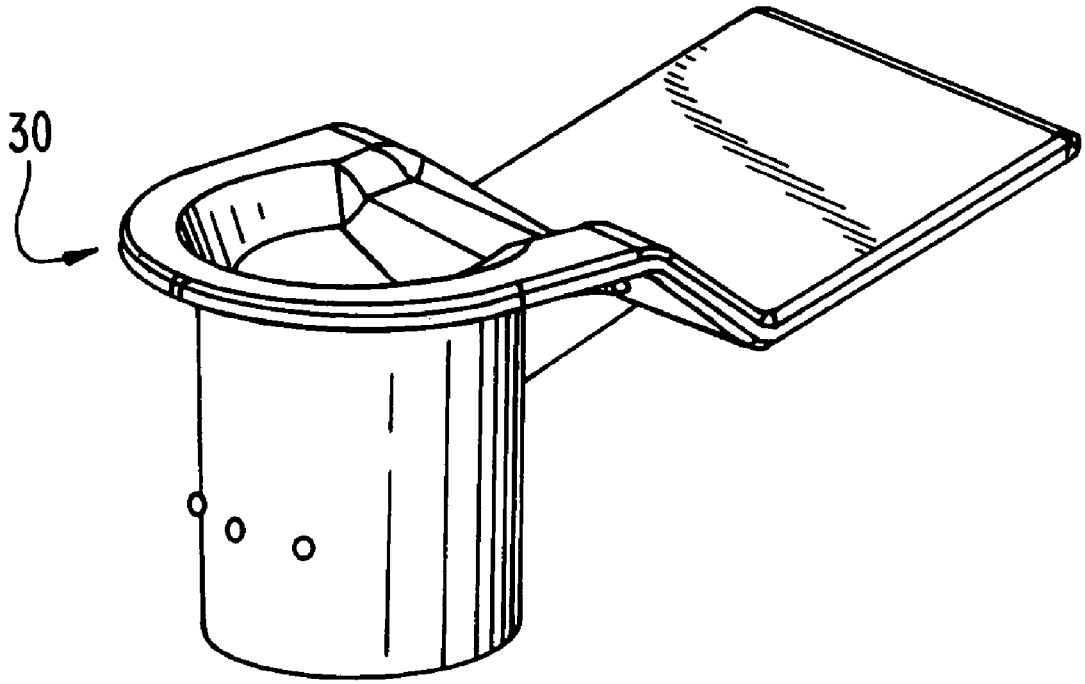
FIG. 3 is a perspective view of a damper according to a preferred embodiment of the present invention.

FIG. 3 illustrates a damper 30 of one embodiment of the invention in more detail. The damper 30 may be inserted in the rotor lid receiving end 10 to prevent damage, dampen noise, or provide a grip for the rotor locking screw 42 or lid locking screw 48. In a preferred embodiment, the damper 30 is glued to the centrifuge 12.

In another preferred embodiment, the damper 30 is glued to the control console 16. An adhesive strip (not shown) may also be used, which can be covered by a backing that can be removed prior to attaching the damper 30 to a centrifuge 12.

In an alternate embodiment, the rotor lid receiving end 10 can be provided with screw holes (not shown) to permit it being fastened to the centrifuge 12. In this embodiment, the rotor lid receiving end 10 can be provided independent of the centrifuge 12 and used to modify existing centrifuges.

The damper 30 may also provide protection to the top of the console 16 or top case 17 and act as a guide for the rotor locking screw 42 or the lid locking screw 48 when the rotor locking screw 42 or the lid locking screw 48 is inserted into the rotor lid receiving end 10.

The rotor lid receiving end 10 may also be molded in a piece of the control panel 16 or the top case 17 of the centrifuge 12. In a preferred embodiment, the control panel 16 contains a recess that acts as the rotor lid receiving end 10. In this embodiment, a damper 30 may also be placed in the rotor lid receiving end 10 to prevent damage, dampen noise, or provide a grip for the rotor locking screw 42 or lid locking screw 48. Preferably, the rotor lid receiving end 10 is molded from a polyolefin or other plastic. Alternatively, the rotor lid receiving end 10 can be molded or constructed from steel, aluminum, or other material that can support the weight of variously sized rotor lids 40. It should be readily recognized that the rotor lid receiving end 10 of the present invention can be molded as an integral piece of the control panel 16 casing or the top case 17.

The rotor lid receiving end 10 may take the form of a blind or through hole 18 molded into the top case 17. In such an embodiment, the through hole 18 diameter and depth are sized to accept a variety of rotor locking screws 42 and lid locking screws 48, which can be inserted vertically. The through hole 18 may also be oriented at an angle or may be located on the side of the top case 17 so that the rotor locking screw 42 or lid locking screw 48 may be inserted other than vertically.

The rotor lid receiving end 10 may also take the form of a semicircular detent 20 and may also include a parabolic detent 22 molded into the top case 17 of the centrifuge 12. The semi-circular detent 20 is sized to receive the circular edge 44 of a lid 40 and the parabolic detent 22 is sized to receive the circular edge 46 of the rotor locking screw 42 or lid locking screw 48 at an angle.

Referring to FIG. 3, the damper 30 of a preferred embodiment is configured so as to receive a rotor locking screw 42 or lid locking screw 48 by inserting the rotor locking screw 42 or lid locking screw 48 into the damper 30, which is located in the rotor lid receiving end 10.

The damper 30 can be made of a flexible rubber-like material, such as an elastomer, so that it is capable of receiving rotor locking screws 42 or lid locking screws 48 of various sizes. In one embodiment, the damper 30 is capable of receiving and securing the rotor lid 40 by inserting the rotor locking screw 42 or lid locking screw 48 into the damper 30. In another embodiment, the rotor lid receiving end 10 is capable of receiving and securing the rotor lid 40 by screwing the rotor locking screw 42 or lid locking screw 48 into the rotor lid receiving end 10. In yet another embodiment, the rotor locking screw 42 or lid locking screw 48 is inserted vertically into the receiving end 10. In still another embodiment, the receiving end 10 is configured to receive the circular edge 44 of a rotor lid 40. In another embodiment, the receiving end 10 is configured to receive the circular edge 44 of a rotor lid 40 and the circular edge of a rotor locking screw 42 or a lid locking screw 48.

Figure 4:
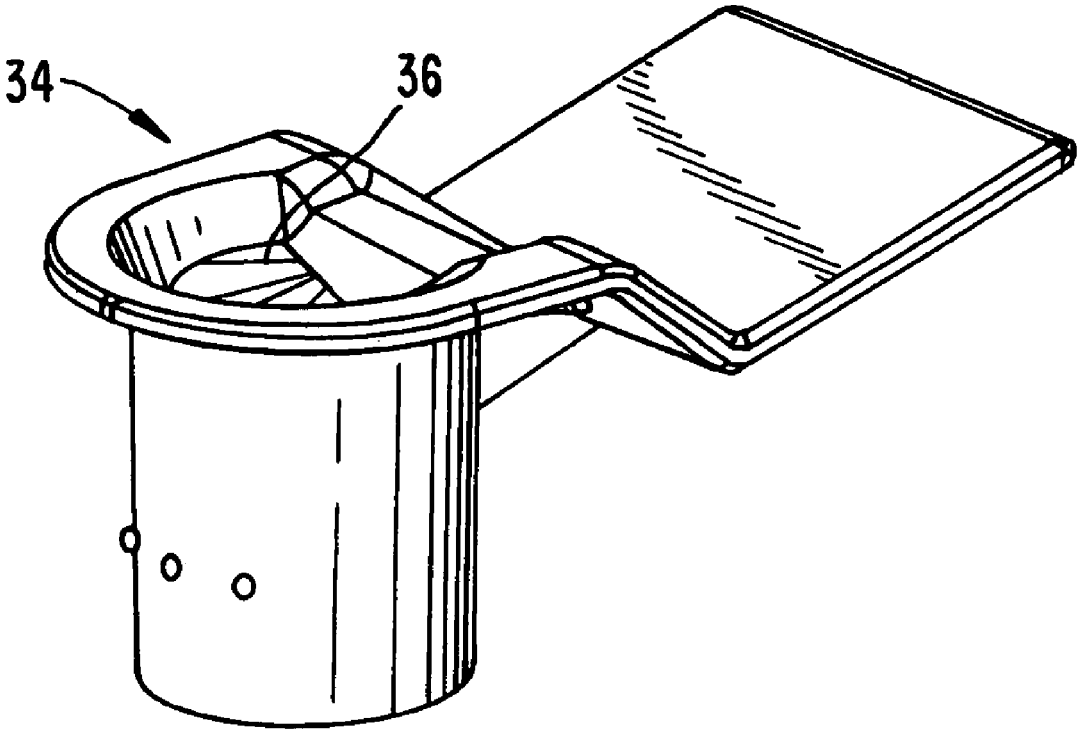
FIG. 4 is a perspective view of a damper according to another embodiment of the present invention.
Figure 5:
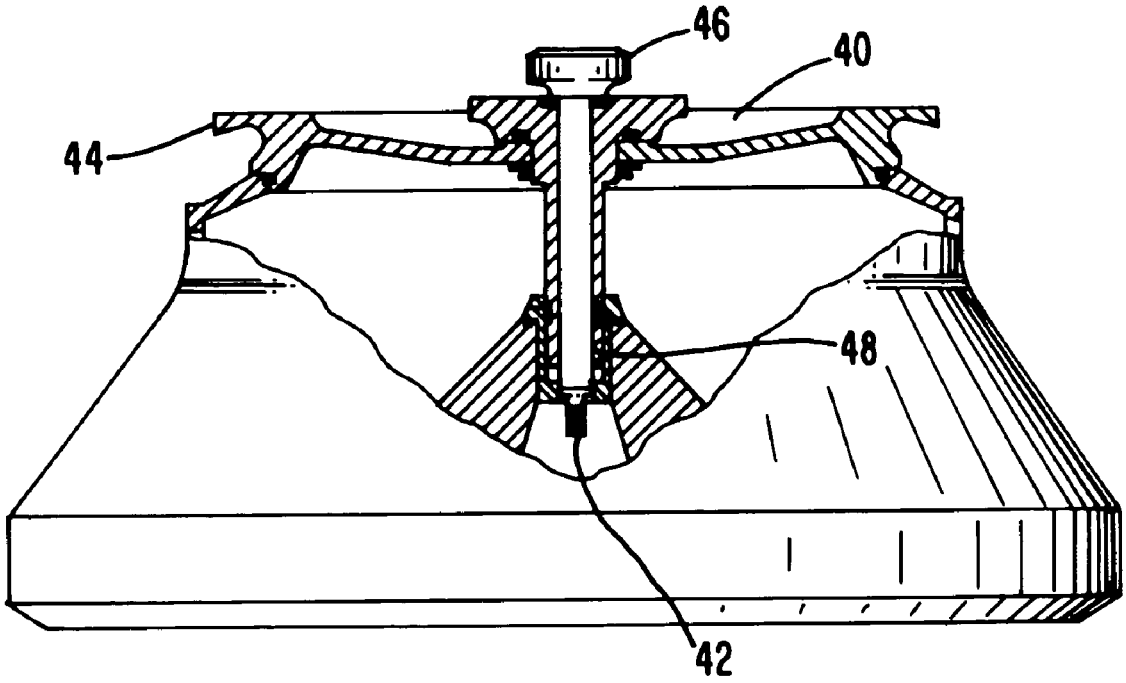
FIG. 5 is a cut-away view of a rotor lid with a locking screw that can be secured by the rotor lid receiving end of FIG. 2.
Figure 6:
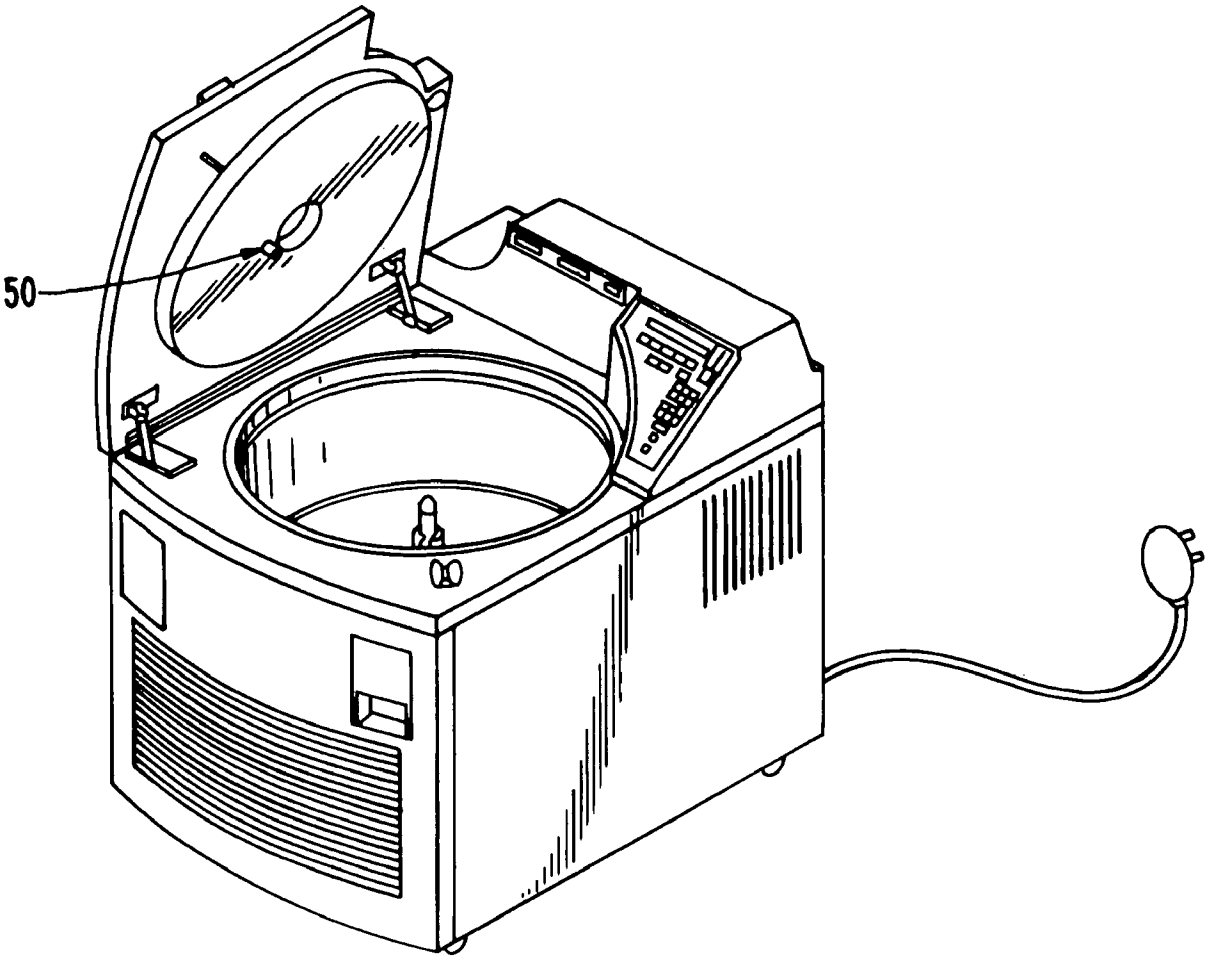
FIG. 6 PRIOR ART
FIG. 6 is a perspective view of a conventional centrifuge with a lid holder.

FIG. 4 illustrates a damper 34 with threads 36 so as to receive a rotor locking screw 42 or lid locking screw 48 that is secured by screwing it into the damper 34.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A rotor lid holder comprises:

a rotor lid receiving end connected to a centrifuge, wherein said rotor lid receiving end is sized and threaded to accommodate a plurality of locking screw sizes and said rotor lid receiving end is connected to at least one of a control console of the centrifuge and a centrifuge housing, said rotor lid receiving end comprises a lid support detent and a locking screw support detent.

2. The rotor lid holder of claim 1, wherein the lid receiving end is a through hole.

3. The rotor lid holder of claim 1, wherein the lid receiving end is vertically disposed.

4. The rotor lid holder of claim 1, wherein said locking screw support detent is angled relative to horizontal.

5. The rotor lid holder of claim 1, wherein said lid support detent is substantially semi-circular in configuration and said locking screw support detent is parabolic in configuration.

* * * * *